US008021083B2

(12) United States Patent
Skarbövig

(10) Patent No.: US 8,021,083 B2
(45) **Date of Patent: *Sep. 20, 2011**

(54) GROUT PACK ASSEMBLY

(76) Inventor: Nils Mittet Skarbövig, Vredenburg (ZA)

( * ) Notice: Subject to any disclaimer, the term of this patent is extended or adjusted under 35 U.S.C. 154(b) by 0 days.

This patent is subject to a terminal disclaimer.

(21) Appl. No.: 12/839,786

(22) Filed: Jul. 20, 2010

(65) Prior Publication Data

US 2010/0284752 A1 Nov. 11, 2010

Related U.S. Application Data

(60) Continuation of application No. 12/396,180, filed on Mar. 2, 2009, now Pat. No. 7,789,593, which is a division of application No. 11/451,191, filed on Jun. 12, 2006, now Pat. No. 7,654,777.

(51) Int. Cl.
*E21D 15/50* (2006.01)

(52) U.S. Cl. ..... 405/288; 248/351; 299/11

(58) Field of Classification Search ..... 405/288, 405/289, 294, 302.2; 248/351; 299/11, 95; 403/300, 305

See application file for complete search history.

(56) References Cited

U.S. PATENT DOCUMENTS

| | | | | | |
|---|---|---|---|---|---|
| 1,265,164 | A | * | 5/1918 | Barry et al. | 405/237 |
| 1,661,238 | A | * | 3/1928 | Sloan | 405/288 |
| 2,110,202 | A | * | 3/1938 | Crane | 403/215 |
| 2,152,636 | A | * | 4/1939 | Crane | 403/215 |
| 2,491,673 | A | * | 12/1949 | Lytle | 24/19 |
| 2,990,166 | A | | 6/1961 | Walsh | |
| 3,041,838 | A | * | 7/1962 | Sieben | 405/272 |
| 3,183,025 | A | * | 5/1965 | Lynch, Jr. et al. | 403/390 |
| 3,397,260 | A | * | 8/1968 | Lamberton | 264/86 |
| 3,525,551 | A | * | 8/1970 | Mallander | 299/11 |
| 3,780,975 | A | * | 12/1973 | Turzillo | 249/1 |
| 3,938,902 | A | * | 2/1976 | Morell | 403/391 |
| 3,984,989 | A | * | 10/1976 | Turzillo | 405/222 |
| 4,212,558 | A | * | 7/1980 | Lang | 403/41 |
| 4,425,057 | A | * | 1/1984 | Hahn | 405/288 |
| 4,497,597 | A | * | 2/1985 | Chlumecky | 405/288 |
| 4,983,077 | A | | 1/1991 | Sorge et al. | |
| 5,095,178 | A | * | 3/1992 | Hollingsworth | 174/94 R |
| 5,823,718 | A | * | 10/1998 | Du Plessis | 405/288 |
| 5,913,641 | A | * | 6/1999 | Long | 405/302.2 |
| 6,196,635 | B1 | | 3/2001 | Rohaly et al. | |
| 6,394,707 | B1 | | 5/2002 | Kennedy et al. | |
| 6,655,877 | B2 | * | 12/2003 | Calhoun | 405/288 |
| 6,793,436 | B1 | * | 9/2004 | Ruel et al. | 403/316 |
| 7,097,389 | B1 | * | 8/2006 | Skidmore et al. | 405/288 |
| 2002/0136607 | A1 | * | 9/2002 | Merz | 405/288 |
| 2004/0096278 | A1 | * | 5/2004 | Van Zyl | 405/289 |
| 2009/0238639 | A1 | * | 9/2009 | Ruel et al. | 403/300 |

FOREIGN PATENT DOCUMENTS

| | | | |
|---|---|---|---|
| WO | WO-99/09299 | * | 2/1999 |

* cited by examiner

*Primary Examiner* — Tara Mayo-Pinnock

(74) *Attorney, Agent, or Firm* — Trego, Hines & Ladenheim, PLLC

(57) ABSTRACT

The invention provides a grout pack assembly having a plurality of elongate elements shaped to extend about a grout pack and which are characterized in that they are configured to control circumferential expansion of the grout pack beyond the expansion permitted through material yield of the elements.

11 Claims, 10 Drawing Sheets

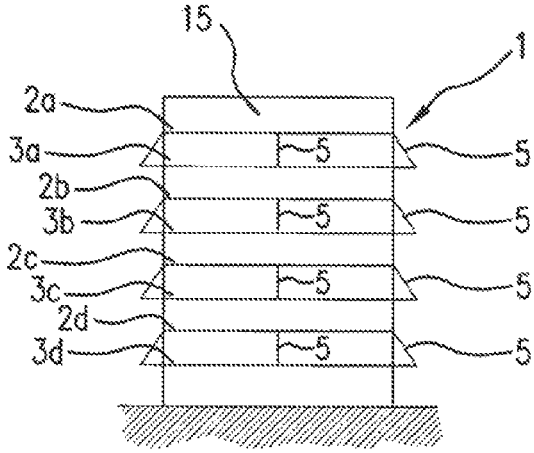
FIG.6
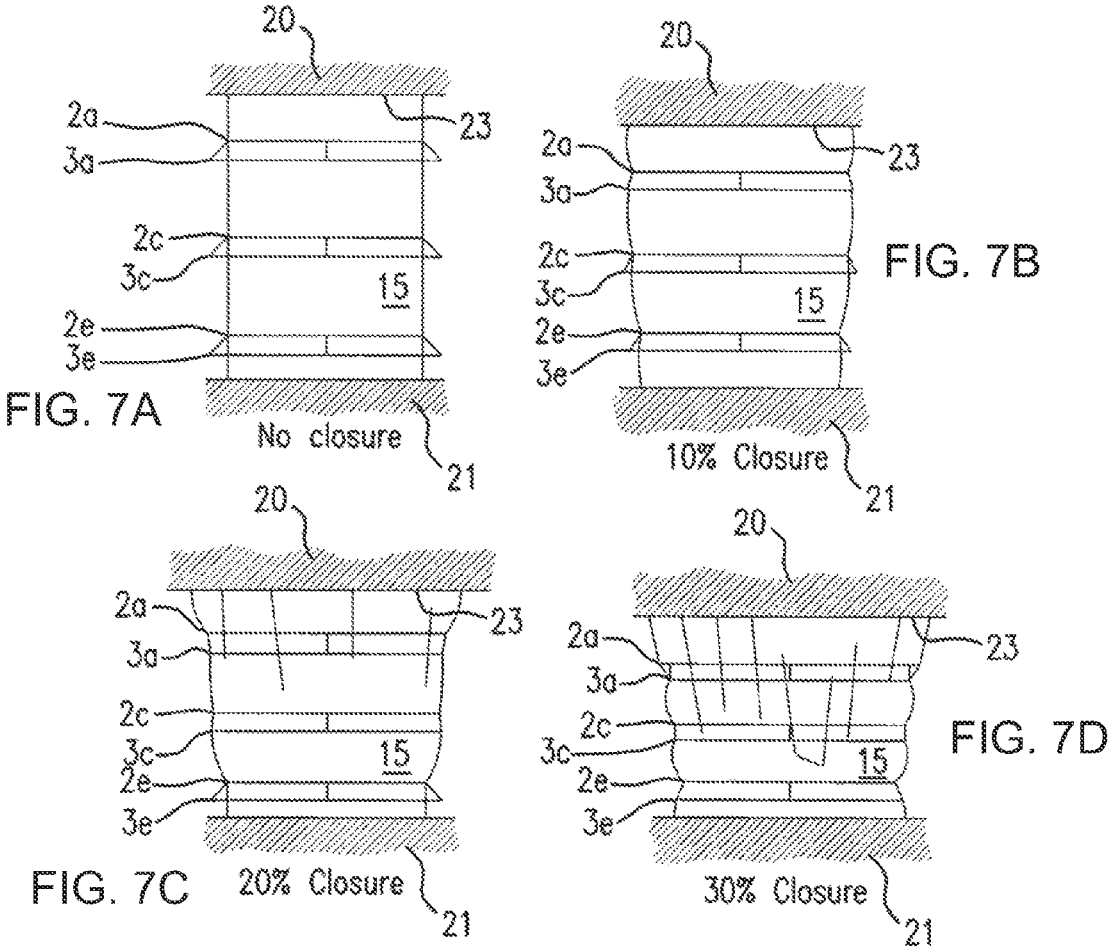

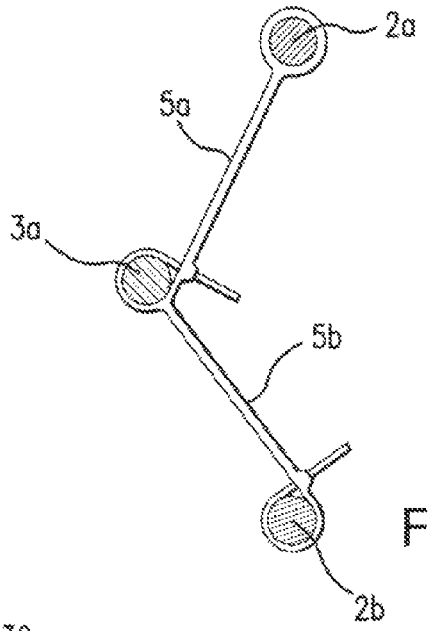
FIG. 8
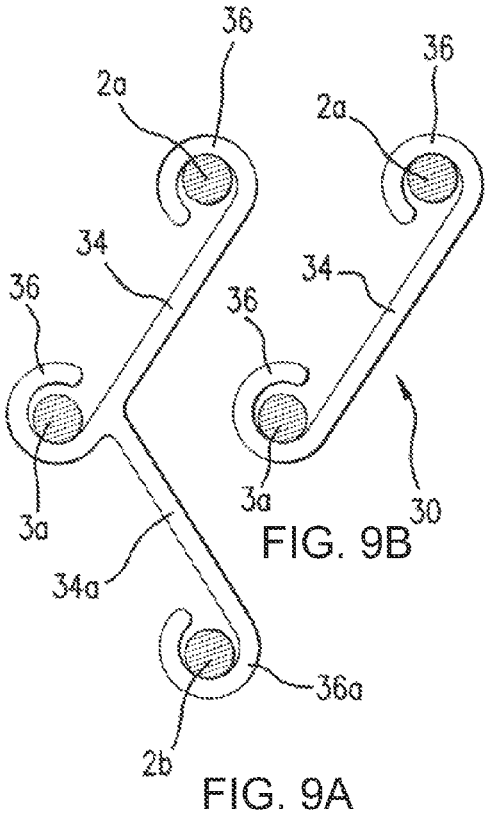
FIG. 9B
FIG. 9A
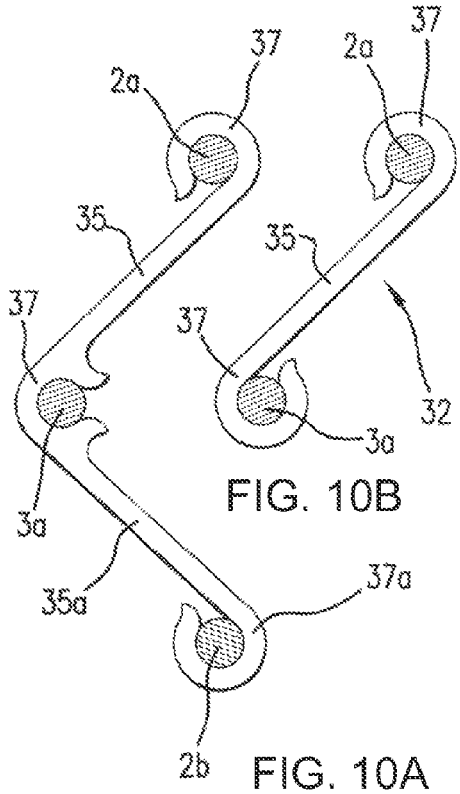
FIG. 10B
FIG. 10A

GROUT PACK ASSEMBLY

CROSS REFERENCE TO RELATED APPLICATIONS

This application is a continuation of copending U.S. patent application Ser. No. 12/396,180 filed Mar. 2, 2009, which is a divisional application of U.S. patent application Ser. No. 11/145,191 filed Jun. 12, 2006, and granted as U.S. Pat. No. 7,654,777 on Feb. 2, 2010, which is a non-provisional United States patent application of South African Patent Application No. 2006/02531 filed on Mar. 28, 2006, the contents of which are incorporated in its entirety herein, and to which priority is claimed.

This invention relates to a grout pack assembly, more particularly to a system for yielding a grout pack.

BACKGROUND OF THE INVENTION

The support of the hanging wall in mining stopes is one of the most basic requirements in mining. Dependent on the type and quality of rock being supported, the depth of mining, the prevalent field stresses, seismicity, stoping width and a number of other factors, stope support can vary across a vast range of materials, configurations and systems. These include, among others, gum poles, timber and composite packs, steel props, back-fill paddocks, unmined ore pillars, hanging wall rock anchors and any combination of the above.

Grout packs are among the increasingly utilized combination support products consisting essentially of a support column formed by a geotextile bag holding cured cemented back-fill or a similar cured cementious grout that is resistant to compression. The geotextile bag is usually protected and supported against lateral dilation of the pack under load by a wire or polymer mesh, as well as a set of additional wire or polymer rings surrounding the bag and mesh horizontally. The grout column is usually combined with timber poles that are required to suspend the bag, net and ring assembly prior to filling with grout.

For the purpose of this background discussion, the structural and support contribution of the timber poles to the behavior and performance of the grout pack shall be disregarded.

Under vertical (axial) load the grout column reduces in length and dilates laterally according to the Poisson's ratio of the grout material. Besides the cohesion of the cemented material, the geotextile bag (a), the surrounding mesh (b), as well as the restraining rings (c) all contribute in some measure to the support resistance of the pack in that they restrain the lateral dilation of the grout column.

(a) The geotextile material is usually woven or knitted from low tenacity polymer fibers and offers little lateral confinement as it stretches easily under load. Although it will provide some useful confinement, its primary function is to provide suitable containment for the grout slurry with optimal drainage and filtering properties.

(b) The secondary mesh basically forms a support structure for the geotextile material, preventing excessive bulging (with the associated increased solids losses through the enlarged pores) under hydrostatic loading of the uncured grout slurry. To add some degree of yield ability to the cured pack, the netting wires (or fibers) are usually oriented at 45° to the axis of the pack allowing the mesh to stretch in the horizontal direction, providing some additional lateral confinement to the pack.

(c) The lateral restraining rings are the major structural confinement of the pack and their strengths contribute directly and significantly to the support resistance of the pack. In conventional grout packs the performance of these rings is essentially dependent on their material properties, characterized primarily by their tensile strength and elongation. Invariably there is a trade-off in terms of these properties in that higher tensile strength generally goes with lower elongation and vice versa.

In stope support the stiffness of a support unit has to be carefully considered, however, as stronger and stiffer is not necessarily better, particularly in seismic stress environments where, under dynamic loading, shear stresses in the hanging wall around a very stiff pack can exceed the strength of the rock resulting in hanging wall failure ("punching"). Under such conditions, a yielding support unit should be able to absorb large and/or sudden rock movement without losing its structural integrity. Similarly, high closure stopes also require yieldability to safely absorb the energy of the closing hanging wall.

In conventional grout packs, the width-to-height ratio of the grout columns is insufficient to generate their own cemented material confinement under compression and the simple tendon lateral restraining rings, as described in (c) above are, therefore, the only significant lateral confinement of these packs.

It is these rings that largely control the compression behavior of the packs. At present, however, they do not permit adequate yielding of the packs from an unyielded initial condition to a fully yielded condition as they rely solely on material deformation to permit yielding. Yield is thus determined by the quality of the steel used for the elements. After expansion permitted by the material yield of the elements the elements break and expansion becomes uncontrolled.

In this specification, yield refers to two separate concepts:

a) yield or elongation as a material property is the deformation of a material (e.g., a metal) beyond its elastic limit; i.e., yield or elongation is irrecoverable plastic deformation;

b) yield as a structural property refers to the plastic deformation of a structure, e.g., a grout pack; an "unyielded condition" refers to the condition of the grout pack immediately after being filled and a "fully yielded condition" refers to the condition of the grout pack after being subjected to axial loading wherein the diameter thereof increases according to the Poisson's ration of the material of which the structure is composed.

OBJECT OF THE INVENTION

It is an object of this invention to provide a grout pack assembly which will at least partially alleviate the above-mentioned problem.

SUMMARY OF THE INVENTION

In accordance with this invention there is provided a grout pack assembly which includes a plurality of elongate elements shaped to extend about a grout pack and characterized in that the elements are configured to control circumferential expansion of the grout pack beyond the expansion permitted through material yield of the elements.

According to one aspect of the invention there is provided for the elongate elements to be configured to include rings of at least a first diameter and a second diameter, the first diameter being smaller than the second and selected to provide restraint in an unyielded condition.

Further features of the invention provide for the rings to have a helical configuration; alternatively for the rings to be concentric, and for the rings of the second diameter to be secured to the rings of the first diameter.

According to a second aspect of the invention there is provided for the elongate elements to include rings configured to have a diameter which can be increased under predetermined radial force.

Further features provide for the rings to have overlapping ends; for at least one collar to be provided over the overlapping ends to provide frictional resistance to relative movement of the overlapping ends; for a collar to be provided at each end; for the collar to be a ferrule, alternatively a chain link with its longitudinal axis inclined to that of the elongate element.

Still further features of the invention provide for the elongate element of each ring to be non-linear; and for there to be at least one undulation in the elongate element; alternately at least one loop in the elongate element.

The invention further provides an element for a grout pack assembly, the element being shaped to extend about a grout pack and characterized in that it is configured to control circumferential expansion of the grout pack beyond the expansion permitted through material yield thereof.

According to one aspect of the invention there is provided for the element to be configured to include rings of at least a first diameter and a second diameter, the first diameter being smaller than the second and selected to provide restraint in an unyielded condition.

Further features of the invention provide for the rings to have a helical configuration; alternatively for the rings to be concentric, and for the rings of the second diameter to be secured to the rings of the first diameter.

According to a second aspect of the invention there is provided for the element to include a ring configured to have a diameter which can be increased under predetermined radial force.

Further features provide for the ring to have overlapping ends; for at least one collar to the provided over the overlapping ends to provide frictional resistance to relative movement of the overlapping ends; for a collar to be provided at each end; for the collar to be a ferrule, alternatively a chain link with its longitudinal axis inclined to that of the element.

Still further features of the invention provide for the ring to be non-linear; for there to be at least one undulation in the ring; alternately at least one loop in the ring.

The invention also provides a method of restraining a grout pack which includes securing about the grout pack a plurality of elongate elements which are configured to control circumferential expansion of the grout pack beyond the expansion permitted through material yield of the elements.

According to one aspect of the invention there is provide for rings of at least a first diameter and a second diameter to be secured about the grout pack, those of the first diameter being smaller than those of the second diameter.

According to a second aspect of the invention there is provided for elongate elements in the form of rings configured to have a diameter which can be increased under predetermined radial force to be secured about the grout pack.

BRIEF DESCRIPTION OF THE DRAWINGS

The invention will be described, by way of example only, with reference to the accompanying drawings in which:

FIG. 6 is a side elevation of the grout pack assembly in FIG. 1 in use;

FIGS. 7A, 7B, 7C, and 7D are a side elevation of the grout pack assembly in FIG. 1 in use;

FIG. 8 is a side elevation of a fastener used in the grout pack assembly in FIG. 1 in an alternate arrangement;

FIGS. 9A and 9B are a side elevation of second embodiments of a fastener for use in a grout pack assembly;

FIGS. 10A and 10B are a side elevation of third embodiments of a fastener for use in a grout pack assembly;

DETAILED DESCRIPTION OF THE DRAWINGS

Figure 1:
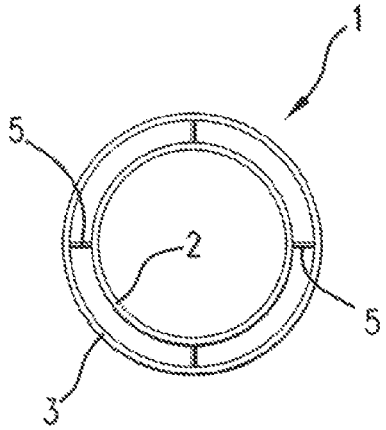
FIG. 1 is a top plan view of a first embodiment of a grout pack assembly.
Figure 2:
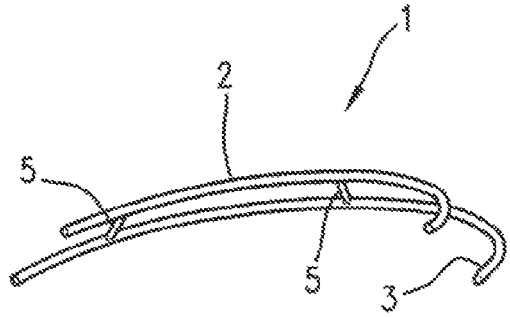
FIG. 2 is an isometric view of part of the grout pack assembly in FIG. 1.

A first embodiment of a grout pack assembly (1) is shown in FIGS. 1 and 2 and includes a pair of rings (2,3) each made from a steel rod with its ends welded together. The rings (2, 3) have a first diameter and second diameter respectively, with the first diameter being smaller than the second diameter.

Figure 3:
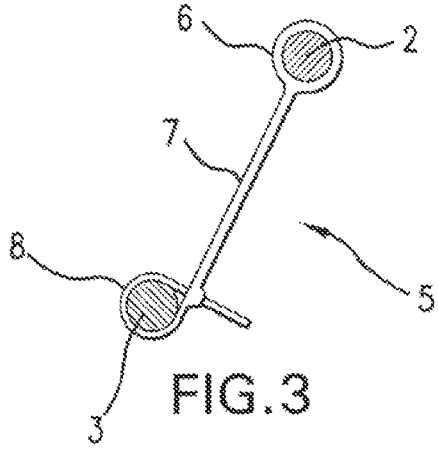
FIG. 3 is a side elevation of a fastener used in the grout pack assembly in FIG. 1.
Figure 4:
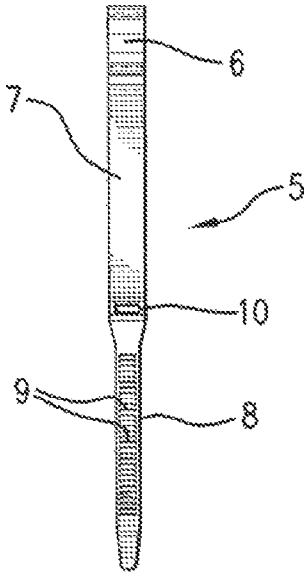
FIG. 4 is a front elevation of the fastener in FIG. 3.
Figure 5:
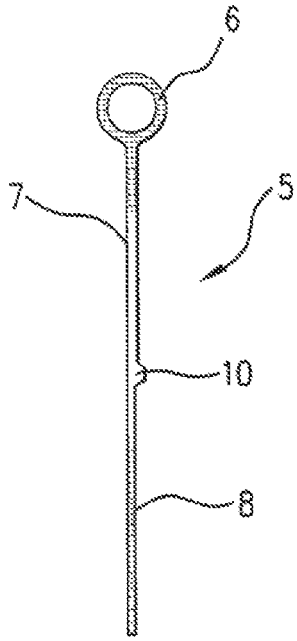
FIG. 5 is a further side elevation of the fastener in FIG. 3.

The rings (2, 3) are concentrically arranged and secured to each other by a number of ties (5) spaced about the circumferences thereof. As shown in FIGS. 3 to 5, each tie (5) has a sleeve (6) molded from a plastics material which is a sliding fit over the ring (2) and from which extends an integral flexible strap (7). The distal end (8) of the strap (7) is slightly narrower than the remainder thereof and has a series of teeth (9) on one side thereof. The end (8) can be fed through a slot (10) with a detent (not shown) therein centrally located on the strap. This permits the end (8) to be fastened about the ring (3) in the manner of a conventional cable tie with the rings (2, 3) coaxial to each other.

In use, as shown in FIG. 6, a number of rings (2*a* to 2*d*) are secured over a grout pack (15) spaced along the length thereof and with the rings (3*a* to 3*d*) suspended therefrom. The diameter of the rings (2*a* to 2*d*) is selected to provide a tight fit over the grout pack and provide restraint in its unyielded condition.

FIGS. 7A-7D show the grout pack (15) as it progressively yields under pressure from movement of the hanging wall (20) towards the foot wall (21). Here, "closure" indicates the degree of movement of the hanging wall (20) towards the foot wall (21) from the time at which the grout pack (15) is installed in position. Also, in these figures, only three ring sets (2*a*, 2*c*, 2*e*, 3*a*, 3*c*, 3*e*) are shown. It has been found in practice that grout packs yield by expanding and disintegrating from the top (23) downwards, as depicted. As this occurs, the grout pack gradually expands to engage the rings (3*a* to 3*e*) whilst still being restrained by the rings (2*a* to 2*e*). At approximately 20% closure the ring (2*a*) has yielded approximately 35% whilst the ring (3*a*) is tightly constricted about the grout pack (15). As expansion occurs down the length of the grout pack (15) the rings (2*c*, 23) similarly yield whilst the rings (3*c*, 3*e*) provide restraint.

At 30% closure, the ring (2*a*) is fully yielded, showing its maximum design yield of about 40%, whilst the ring (3*a*) restrains the grout pack (15) and continues yielding. The performance of the ring (2*a*) is assisted by the ring (3*a*). At 30% closure, ring (2*e*) is relatively undistorted with ring (3*e*) only commencing to restrain the grout pack (15).

The grout pack assembly thus permits controlled circumferential expansion of the grout pack between the unyielded condition and fully yield condition. This is in major part through configuring the system to permit circumferential expansion of the grout pack beyond the expansion which would occur through simple yield of the material used in the system, in this embodiment by the provision of the rings of the second larger diameter.

It will be appreciated, however, that many other embodiments of a grout pack assembly exists which fall within the scope of the invention, particularly as regards the material used for the rings and the cross-sectional shape thereof. Also, the rings can be secured in any convenient configuration and, as shown in FIG. 8, the ring (2*b*), adjacent ring (3*a*), can be suspended from the ring (3*a*) using a tie (5*b*). Also, ties of any suitable configuration can be used. As shown in FIGS. 9A and 9B and 10A and 10B, ties (30, 32), could include an elongate body (34, 35) with hook formations (36, 37) at either end thereof in which the rings (2*a*, 3*a*) can be secured. As also illustrated in these figures, each body (34, 35) can have an arm (34*a*, 35*a*) extending laterally therefrom having a hook (36*a*, 37*a*) at the end thereof for securing a further ring (2*b*).

Figure 11A:
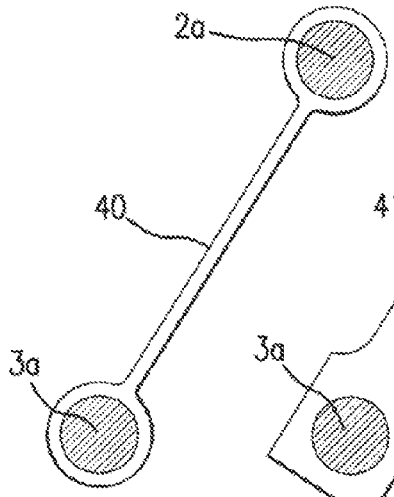
FIGS. 11A, 11B, and 11C are a side elevation of fourth embodiments of a fastener for use in a grout pack assembly.
Figure 11B:
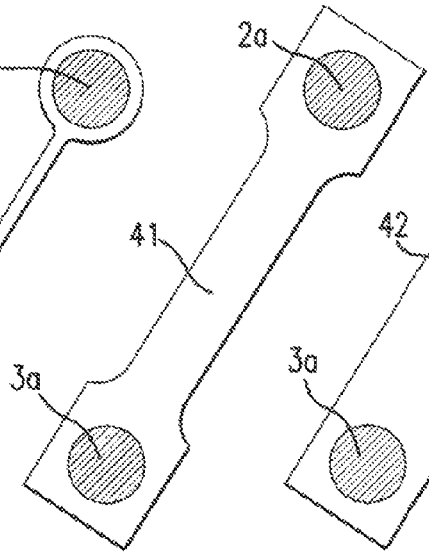
Figure 11C:
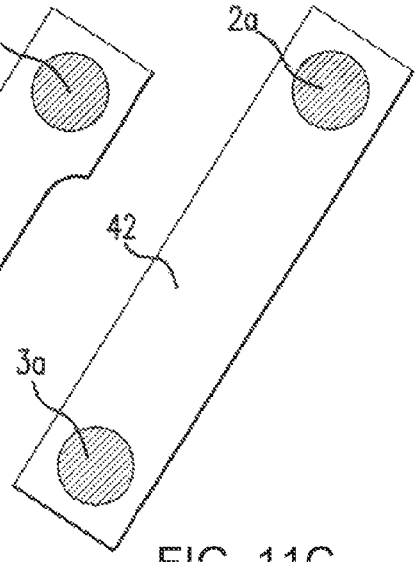

Further alternatively, as shown in FIGS. 11A-11C, the ties (40, 41, 42) can simply be elongate bodies having apertures at either end thereof through which the rings (2*a*, 3*a*) can be inserted.

Figure 12:
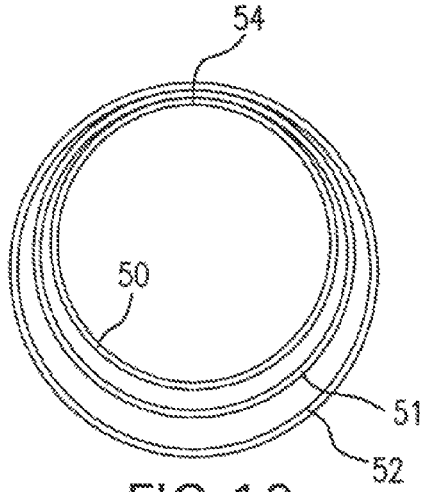
FIG. 12 is a top plan view of a second embodiment of a grout pack assembly.
Figure 13:
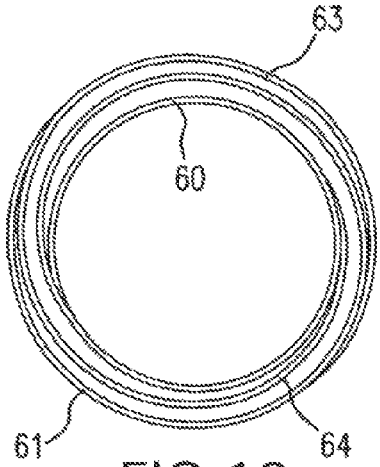
FIG. 13 is a top plan view of a third embodiment of a grout pack assembly.
Figure 14:
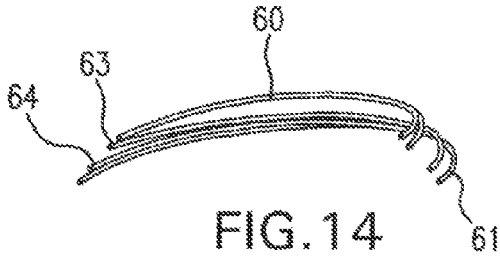
FIG. 14 is an isometric view of part of the grout pack assembly in FIG. 13.

More than two rings of increasing diameter can also be used and it is not necessary for the rings to be co-axial. As shown in FIG. 12, three rings (50, 51, 52) of different diameter can be used and these can be secured together at a single point (54) by welding or by using a fastener.

Further alternatively, a pair of rings (60, 61) of first and second diameter, can be secured together using a pair of helically extending elongate elements (63, 64). This helical configuration in effect provides several restraining rings of increasing diameter and provides a much smoother transition of restraining duty from the ring of smaller diameter (60) to that of larger diameter (61).

Figure 15:
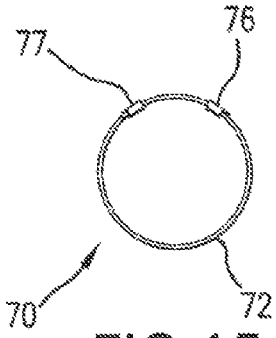
FIG. 15 is a top plan view of a fourth embodiment of a grout pack assembly.
Figure 16:
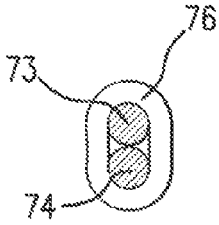
FIG. 16 is a sectional end view of part of the grout pack assembly in FIG. 15.
Figure 17:
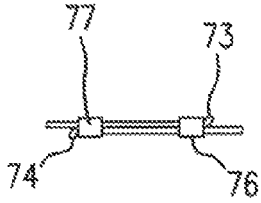
FIGS. 17 to 19 are side elevations of part of the grout pack assembly in FIG. 15 moving from an unyielded to a fully yielded condition.

It is, however, not necessary to use rings of different diameter to control expansion of a grout pack. Instead, a ring can be provided which can be increased in diameter through a predetermined radial force by virtue of its configuration rather than through material deformation of the material of the ring. As shown in FIGS. 15 to 17, a ring (70) providing part of a grout pack restraining system is formed from an elongate steel element (72) with the ends thereof (73, 74) overlapping. A collar (76, 77), in this embodiment a ferrule, is secured over the overlapping sections at each end (73, 74). The ferrules (76, 77) are swaged onto the overlapping ends (73, 74) to permit relative movement of these. The swaging force determines the frictional resistance to movement. The ends (73, 74) are bent outwardly to prevent them from pulling through the ferrules (76, 77).

Figure 18:
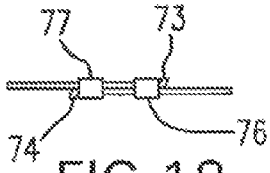
Figure 20:
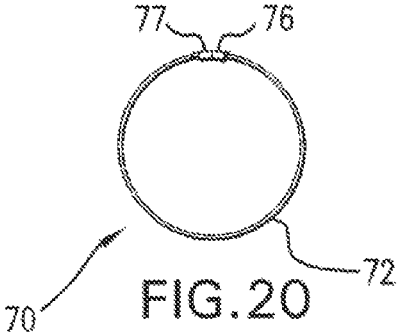
FIG. 20 is a top plan view of the grout pack assembly in FIG. 15 in a fully yielded condition.
Figure 19:
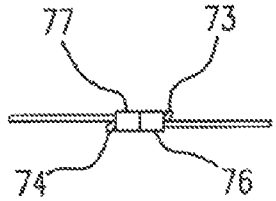
Figure 21A:
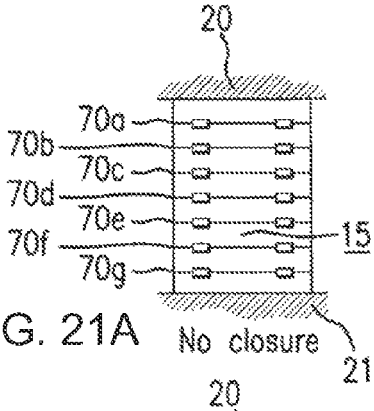
FIGS. 21A, 21B, 21C, and 21D are a side elevation of the grout pack assembly in FIG. 15 in use.
Figure 21B:
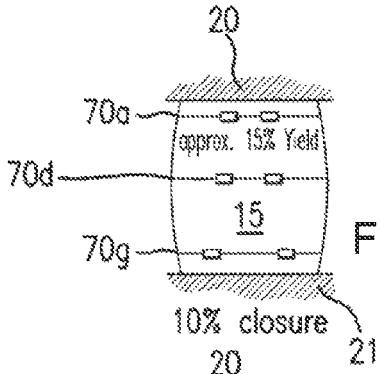
Figure 21C:
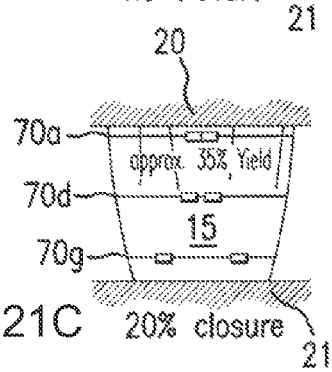
Figure 21D:
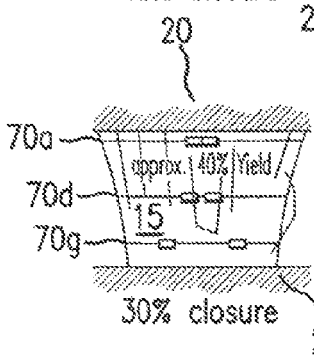

Under predetermined internal force on the ring (70) its diameter increases through frictional yield between the overlapping ends (73, 74) as shown in FIGS. 17 to 19. In the fully yielded condition, shown in FIGS. 19 and 20, the ferrules (76, 77) abut preventing further relative outward movement of the ends (73, 74) and hereafter the ring (70) yields through material deformation.

In use, as shown in FIGS. 21A-21D, a plurality of rings (70*a* to 70*g*) are secured about a grout pack (15) spaced along the length thereof. As described with reference to FIGS. 7A-7D, closure of the hanging wall (20) and foot wall (21) causes compression and a deformation of the grout pack (15). The rings (70*a* to 70*g*) control the circumferential expansion of the grout pack (15) initially through frictional resistance and thereafter by material deformation until fully yielded as described above.

Figure 22:
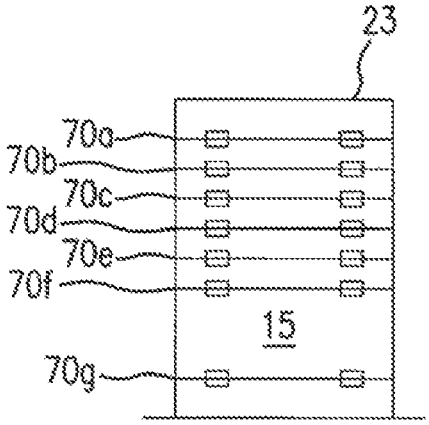
FIG. 22 is a side elevation of the grout pack assembly in FIG. 15 in use in a second configuration.
Figure 23:
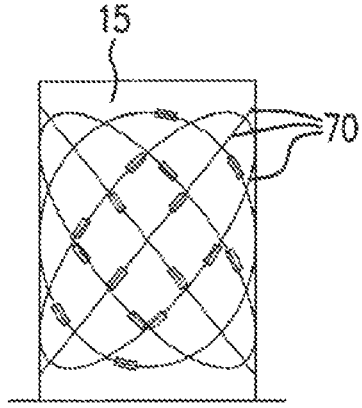
FIG. 23 is a side elevation of the grout pack assembly in FIG. 15 in use in a third configuration.

Any suitable configuration of rings (70*a* to 70*g*) can be used. As illustrated in FIG. 22, the ring (70*a* to 70*j*) can be positioned adjacent the upper end (23) of the grout pack (15) to control expansion there. It is, however, not necessary to secure the rings (70) coaxially with the grout pack (15). As shown in FIG. 23, the rings could be secured elliptically about the grout pack to form a type of net jacket, and these could be interspersed with non-yielding rings of conventional construction.

Figure 24:
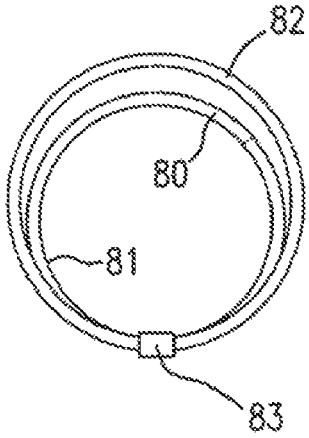
FIG. 24 is a top plan view of a fifth embodiment of a grout pack assembly.
Figure 25:
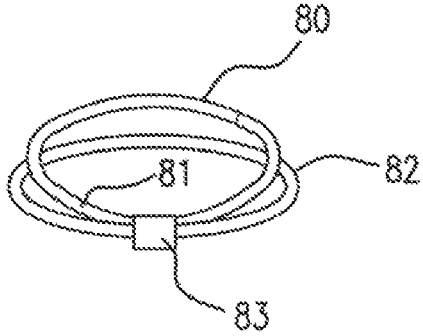
FIG. 25 is an isometric view of part of the grout pack assembly in FIG. 24.

Frictional expansion of the ring can also be achieved through other configurations. As illustrated in FIGS. 24 and 25, an elongate element (80) can be folded into a pair of overlapping rings (81, 82) with the diameter of the first ring (81) being of smaller diameter than that of the second ring (82) and of the desired initial restraining diameter in an unyielded condition. A ferrule (83) joins the overlapping portion of the elongate element (80) and provides frictional resistance to circumferential expansion of the ring (81). It will be understood that expansion of the ring (81) causes similar contraction of the ring (82) and at the point where the rings (81, 82) have equal diameter, both will undergo material deformation under continued expansion of a grout pack over which they are secured.

It will also be understood that the ring (81) could be formed with the ends of the elongate element (80) overlapping as described with reference to FIGS. 15 to 17 to provide further frictional expansion of this ring. With such a configuration it may be desirable to secure the overlapping portion of the elongate element together to prevent relative movement. This will provide a grout pack restraining system which combines the characteristics of the system described with reference to FIGS. 1 and 2 with that of the system described with reference to FIGS. 15 to 17.

Figure 26:
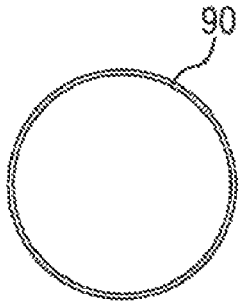
FIG. 26 is a top plan view of a sixth embodiment of a grout pack assembly.
Figure 27:
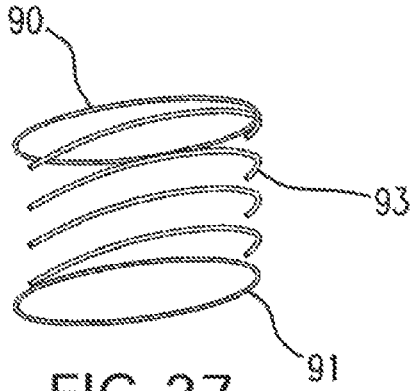
FIG. 27 is an isometric view of part of the grout pack assembly in FIG. 26.

Further alternatively, as shown in FIGS. 26 and 27, a pair of rings (90, 91) of equal diameter can be secured together by a contiguous helical member (93) which provides different yield characteristics because of its length and also provides friction against the expanding grout pack.

Figure 28:
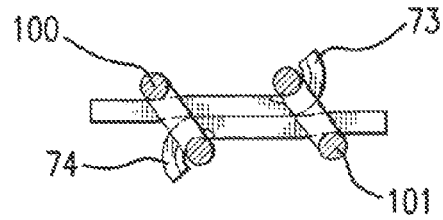
FIG. 28 is a part sectional side elevation of an alternate collar for use in the grout pack assembly in FIG. 15.
Figure 29:
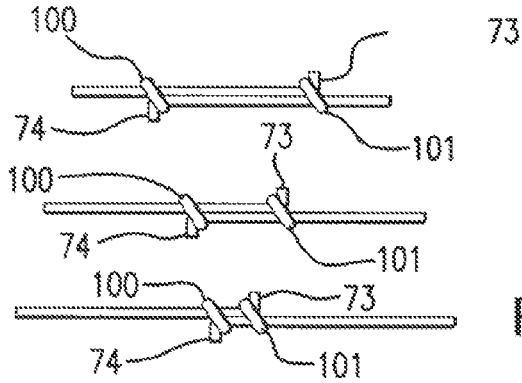
FIG. 29 shows side elevations of the collars in FIG. 29 in use moving from an unyielded to a fully yielded condition.

Furthermore, any suitable means of providing frictional resistance between overlapping ends of a ring can be used. As illustrated in FIG. 28, a chain link (100,101) can be welded to each end (73, 74) inclined to the axis of the elongate element and over the overlapping ends. Under relative movement of the ends, the chain links (100, 101) cause the ends moving relative to them to be deformed under tensile load and this deformation together with the accompanying friction provides the required yield resistance. The sequential expansion of the overlapping ends is shown in FIG. 29 and is similar to that illustrated in FIGS. 17 to 19.

Figure 30:
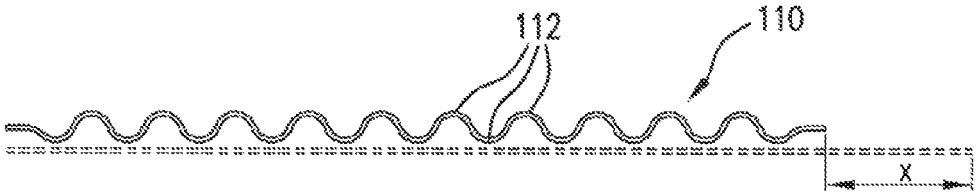
FIG. 30 is a side elevation of an elongate element for use in a seventh embodiment of a grout pack assembly.
Figure 31:
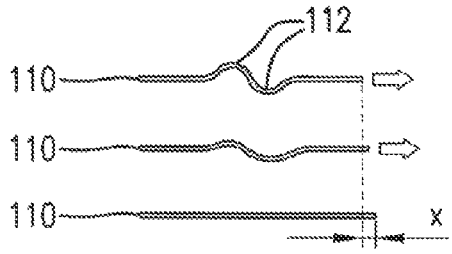
FIG. 31 is a side elevation of part of the elongate element in FIG. 30 moving from an unyielded to a fully yielded condition.

Resistance to expansion can also be achieved through use of a non-linear elongate element (110) as illustrated in FIG. 30. Here, an elongate steel element is formed with a series of undulations (112) along its length. As illustrated in FIG. 31, the overall length of the element (110) is increased when the ends thereof are forced in opposite directions and the undulations reduce in magnitude until the element is linear. The increase in length for each undulation is indicated in FIG. 31 by "x".

Figure 32:
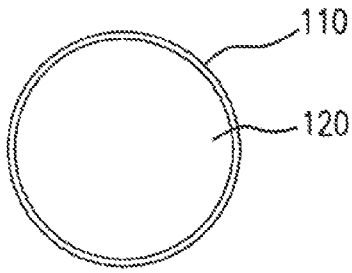
FIG. 32 is a top plan view of a seventh embodiment of a grout pack assembly.
Figure 33:
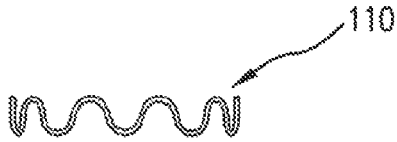
FIG. 33 is a side elevation of part of the grout pack assembly in FIG. 32.
Figures 34A, 34B, 34C, 34D:
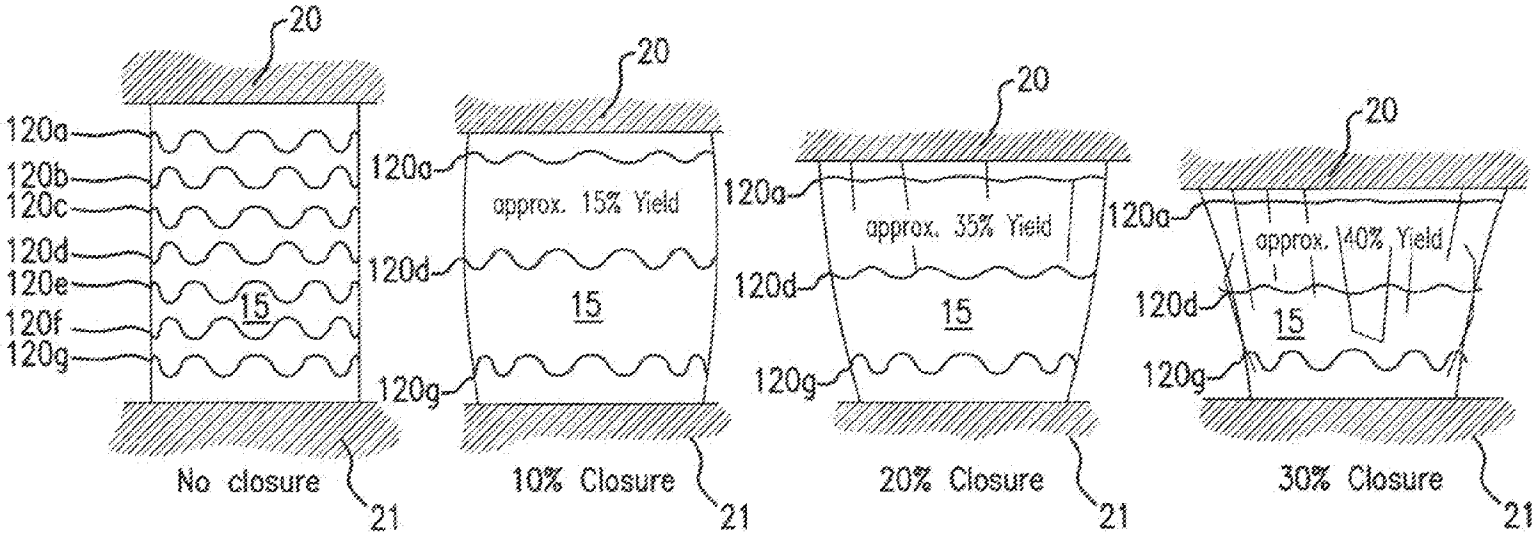
FIGS. 34A, 34B, 34C, and 34D are a side elevation of the grout pack assembly in FIG. 32 in use.

A ring (120) formed from the elongate element (110) is shown in FIGS. 32 and 33 and is formed with the undulations extending in the axial direction. It will be understood that applying an internal radial force to the ring will cause an increase in diameter thereof against the resistance provided by the undulations to straightening. Rings (120*a* to 120*g*) are shown in use over a grout pack (15) in FIGS. 34A-34D. Similarly to the restraining systems illustrated with reference to FIGS. 7A-7D and 21A-21D, the rings (120*a* to 120*g*) are secured over the grout pack spaced along the length thereof. The closure of the hanging wall (20) and foot wall (21) causes deformation of the grout pack (15) as previously discussed and this is controlled by the rings (120*a* to 120*g*) as illustrated in FIGS. 34A-34D.

Figure 35:
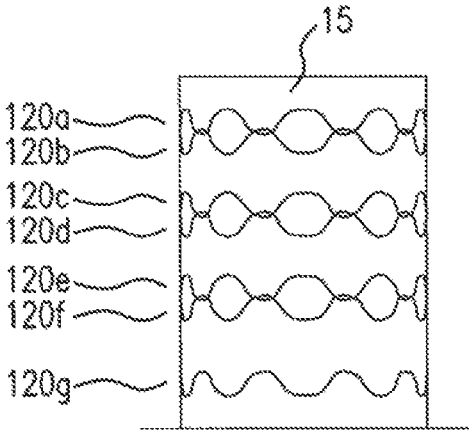
FIG. 35 is a side elevation of the grout pack assembly in FIG. 32 in use in a second configuration.

It will be appreciated that the rings (120*a* to 120*g*) can be paired in a meshed configuration as illustrated in FIG. 35.

Figure 36:
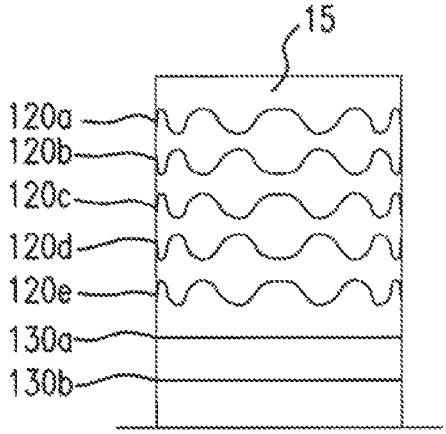
FIG. 36 is a side elevation of the grout pack assembly in FIG. 32 in use in a third configuration.
Figure 37:
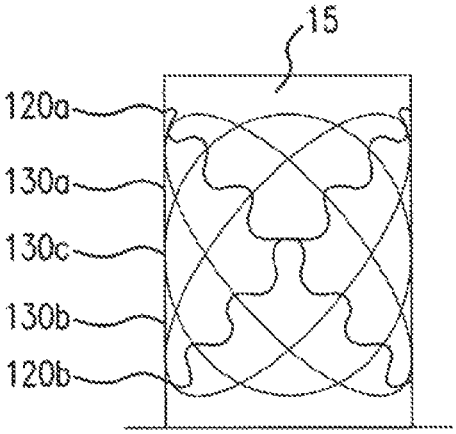
FIG. 37 is a side elevation of the grout pack assembly in FIG. 32 in use in a fourth configuration.
Figure 38:
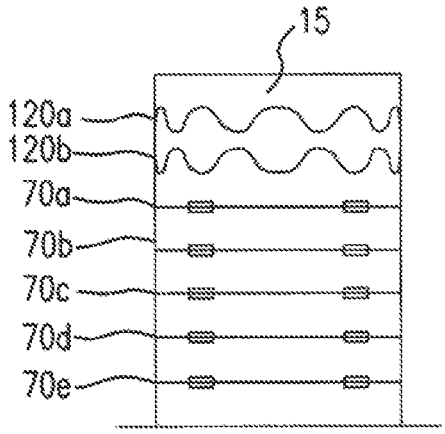
FIG. 38 is a side elevation of the grout pack assembly in FIG. 32 in use in a fifth configuration.

Alternatively, as shown in FIG. 36, rings (120*a* to 120*e*) could be used together with non-expanding rings (130*a*, 130*b*) located co-axially about the grout pack (15) or in an elliptical configuration as shown in FIG. 37. The rings (120*a*, 120*b*) could also be used with rings (70*a* to 70*e*) of the type described in FIGS. 15 to 17 as shown in FIG. 38.

Figure 39:
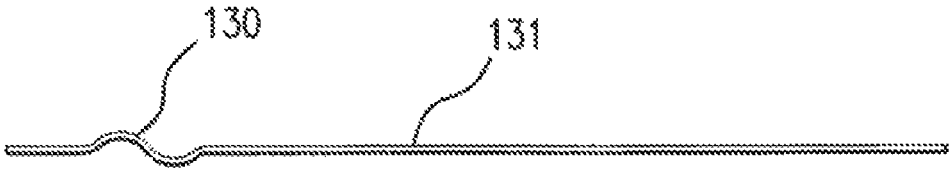
FIG. 39 is a side elevation of an elongate element for use in an eighth embodiment of a grout pack assembly.
Figure 40:
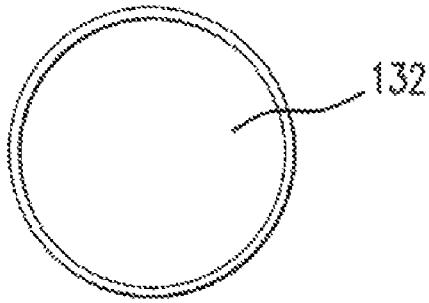
FIG. 40 is a top plan view of an eighth embodiment of a grout pack assembly.
Figure 41:
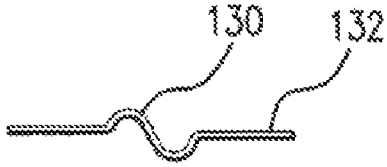
FIG. 41 side elevation of part of the grout pack assembly in FIG. 41.

The degree of expansion can be controlled by the number of undulations in the elongate element. As shown in FIGS. 39 to 41, a single undulation (130) can be provided in the elongate element (131) to provide a ring (32) which provides only a small degree of circumferential expansion.

Figure 42:
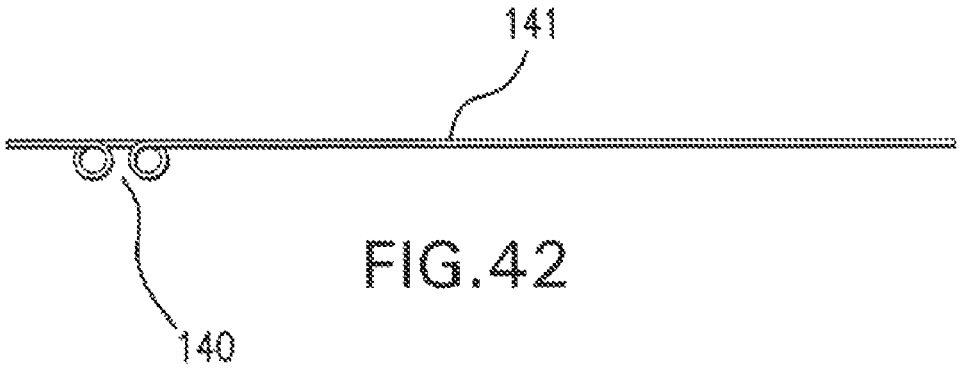
FIG. 42 is a side elevation of an elongate element for use in a ninth embodiment of a grout pack assembly.

Also, as shown in FIG. 42, loops (140) can be provided in the elongate element (141) instead of undulations to permit expansion thereof.

The grout pack assembly of the invention thus provides a simple yet highly effective means to control circumferential expansion of a grout pack between an unyielded condition and a fully yielded condition. The elongate elements of the system are configured to permit expansion of the grout pack about which they are secured greater than the expansion permitted by simple material deformation of the elements. Many other embodiments which fall within the scope of the invention will be apparent to a person skilled in the art.

I claim:

1. A grout pack assembly, comprising:

(a) an inflatable grout bag adapted to contain settable cementitious grout pumped into the bag during installation thereof and which, when expanded and set, forms a generally right cylindrical support column capable of bearing a load along an axial length thereof;

(b) at least one restraining ring that extends about the grout bag to provide support against circumferential expansion of the grout bag, the at least one restraining ring being formed by an elongate element, the at least one restraining ring having at least one expansion zone adapted to permit a diameter of the ring to be increased from a first diameter to a second diameter in response to expansion of the grout bag without material deformation of the at least one elongate element; and (c) at least one connector connecting a first section of the elongate element to a second section of the elongate element in an overlapping configuration to form the at least one expansion zone, wherein the connector imparts a pre-determined compressive force on the second section that permits the first section and the second section to move relative to one another and creates a frictional resistance to movement of the second section relative to the first section, thereby allowing the ring to increase in diameter from the first diameter to the second diameter, and providing a progressive yield characteristic to the grout pack assembly.

2. The grout pack assembly according to claim 1, wherein a first end of the first section and a second end of the second section are bent outwardly to prevent the first section and second section from pulling through the at least one connector.

3. The grout pack assembly according to claim 1, wherein the at least one connector is a collar that provides a predetermined swaging force between the first and second sections.

4. The grout pack assembly system according to claim 1, wherein a pair of connectors connect the first section and the second section in the overlapping configuration, the connectors being arranged such that when the ring is in its first diameter, the connectors are spaced-apart and when the ring is in its second diameter, the connectors abut and prevent the first and second sections from moving relative to each other.

5. The grout pack assembly according to claim 1, wherein the at least one connector is a chain link with its longitudinal axis inclined to that of the element.

6. The grout pack assembly according to claim 1, wherein the at least one elongate element is made from a steel rod or wire.

7. The grout pack assembly according to claim 1, wherein a plurality of restraining rings extend circumferentially about the grout bag in a vertically spaced arrangement up at least a part of the axial length of the grout bag.

8. The grout pack assembly according to claim 7, wherein the rings are spaced adjacent an operatively upper end of the grout bag.

9. The grout pack assembly according to claim 1, wherein a plurality of restraining rings extend elliptically about the grout bag to form a jacket of restraining rings.

10. The grout pack assembly according to claim 9, wherein the jacket of restraining rings are interspersed with non-yielding rings.

11. The grout pack assembly according to claim 1, wherein the connector imparts a compressive force upon the first section.

* * * * *